United States Patent [19]

Back et al.

[11] Patent Number: 4,699,741

[45] Date of Patent: Oct. 13, 1987

[54] METHOD OF PHLEGMATIZATION OF CRYSTALLINE EXPLOSIVES AND OTHER EXPLOSIVE CRYSTALLINE SUBSTANCES, AS WELL AS A METHOD OF PRODUCING PLASTIC BOUND EXPLOSIVE AND SUBSTANCES PRODUCED ACCORDING TO THE METHOD

[75] Inventors: Sigurd Back; Jan-Olof Nyqvist; Per Ericsson, all of Karlskoga, Sweden

[73] Assignee: Nobel Kemi AB, Karlskoga, Sweden

[21] Appl. No.: 911,700

[22] Filed: Sep. 26, 1986

[30] Foreign Application Priority Data

Sep. 27, 1985 [SE] Sweden ..... 8504468
Sep. 27, 1985 [SE] Sweden ..... 8504467

[51] Int. Cl.[4] ..... C06B 21/00

[52] U.S. Cl. ..... 264/3.4; 149/11; 149/87; 149/92; 149/93; 149/105; 149/109.6; 102/290

[58] Field of Search ..... 149/11, 87, 92, 93, 149/105, 109.6; 264/3.1, 3.3, 3.4; 102/290

[56] References Cited

U.S. PATENT DOCUMENTS

| | | | |
|---|---|---|---|
| 4,090,894 | 5/1978 | Reed et al. | 264/3.1 X |
| 4,092,187 | 5/1978 | Hildebrant et al. | 149/11 |
| 4,336,209 | 6/1982 | Glyden et al. | 264/3 R |
| 4,357,185 | 11/1982 | Ringbloom | 149/11 X |
| 4,369,688 | 1/1983 | Yunan | 264/3.3 X |
| 4,376,083 | 3/1983 | Ulteen | 264/3 D |
| 4,380,186 | 4/1983 | Buhrer | 86/20 D |
| 4,450,124 | 5/1984 | Christmann et al. | 264/3 R |
| 4,488,916 | 12/1984 | Wanninger et al. | 149/2 |

*Primary Examiner*—Peter A. Nelson
*Attorney, Agent, or Firm*—Pollock, Vande Sande & Priddy

[57] ABSTRACT

The disclosure primarily relates to a method of phlegmatizing crystalline or otherwise particulate explosive substances or compositions in which these are included, by first coating the discrete particles with a thin layer of oxazolin wax in order thereafter to carry out a conventional wet-granulation with a true phlegmatization agent or a binder agent, such as one of the wax types included under different explosive standards or a plastic composition. The invention also concerns products manufactured according to said method.

18 Claims, No Drawings

METHOD OF PHLEGMATIZATION OF CRYSTALLINE EXPLOSIVES AND OTHER EXPLOSIVE CRYSTALLINE SUBSTANCES, AS WELL AS A METHOD OF PRODUCING PLASTIC BOUND EXPLOSIVE AND SUBSTANCES PRODUCED ACCORDING TO THE METHOD

TECHNICAL FIELD

The present invention primarily relates to a method of phlegmatization—or as it is also called in this Art desensitization—of crystalline explosives such as octogen, hexogen, PETN and other crystalline or particulate explosive substances and compositions in which such explosives or explosive substances are included. The invention further relates to a method of producing plastic bound explosives or PBX. The invention finally also relates to substances produced according to said methods.

BACKGROUND ART

As examples of phlegmatized compositions which preferably may be manufactured according to the invention mention might be made of octonal and hexotonal in which there is normally included octogen and hexogen, respectively, as well as TNT, powdered aluminum and a phlegmatization agent normally in the form of wax. For octogen and hexogen, there are military standards which require that these substances be phlegmatized with one or other of a number of defined wax qualities. The commonest is petroleum wax, but also acid wax, ester wax or their combinations may occur. Besides, the phlegmatization of ocotogen, hexogen and PETN crystals etc, by a granulation process, and coacting of these with a fusable substance such as a wax or the like is a sine quanon in order that such crystalline explosives can be melted together at all, or be compacted to form unitary blasting charges or explosive devices. In such an event, the phlegmatization agent serves as a binder, and in compaction, also as a lubricant.

Plastic bound explosives or PBX also consist of crystalline or otherwise particulate explosive substances such as hexogen, octogen or PETN which however are agglutinated and fused to the desired charge sizes and configurations with a suitable plastic as binder and by compaction and possibly the employment of heat. As examples of plastic binders for PBX, mention might be made of Nylon and polystyrene. Particulate, non-explosive substances such as powdered aluminum and graphite may also be included in PBX. In purely general terms. These plastic bonded explosives (PBX) are produced by adding a plastic solution or dispersion to an aqueous slurry or dispersion of the contemplated crystalline and/or particulate explosive, whereafter the solvent or dispersion agent in which the explosive was dissolved or dispersed is driven-off or otherwise removed under continous agitation, whereupon the plastic binder in its turn is caused to deposit on the explosive crystals or particles. As a rule, the plastic coating also gives rise to a certain granulation, as the discrete crystals or particles are baked together to form granules. These plastic-coated granules may then, be compaction and heat, be baked together into blasting charges or explosive devices of the desired size and shape.

As has been mentioneed above, there are military specifications which require that octogen and hexogen—even in bulk form—must be phlegmatized with a wax which meets certain standards. There is a plurality of wax types employed to this end, of which mention might be made of Wax Composition 1 and D2, but other wax types may also come into consideration. Normally, the phlegamtization of octogen and hexogen is effected in wet granulation in water in which the wax is batched to the aqueous bath whose temperature is raised to such a point at which all wax is melted, whereafter the temperature of the water is successively reduced so that the wax is deposited on the explosive crystals. A uniform distribution of the phlegamtization agent over the crystals is obtained by suitable agitation and temperature regulation of the granulation suspension. To a certain degree, it is also possible by these means to govern the size of the thus obtained granules.

BACKGROUND ART

However, it is generally known among persons skilled in this Art that it may often be difficult to produce uniform, completely evenly phlegmatized granules of explosives as herein disclosed, since the wax displays an unwillingness to spread sufficiently well on the crystal surfaces and has a manifest tendency to form large and small flocks with the particulate substances. The flocculation tendencies of the wax become particularly troublesome in the production of octonal and hexotonal in which the wax, above all, occasions flocculation of the powdered aluminum included as a component part in these composite explosives.

The same type of problems also occur when producing plastic bound explosives or PBX. Many of the plastics which are otherwise excellent PBX, binders, even including the generally employed Nylon, thus suffer from the drawback that they display a poor degree of adhesion to the explosive crystals. This entails that a considerable proportion of the crystals may remain uncoated, while the plastic instead forms, together with other explosive crystals, large aggregates with a high concentration of plastic.

SUMMARY OF THE INVENTION

We have now found a method for eliminating said problems to a considerable degree, when producing as well plegmatized crystalline explosives as PBX. Thus, according to the present invention, the explosives crystals are initially coated with an oxazolin wax which, in its turn is coated by the phlegmatization agent proper, or a suitable plastic binder. Oxazolin wax is a double unsaturated heterocyclic compound extracted from nitroparaffins. It has a melting point of 160° C. and a molecular weight of $\approx$1352. It is currently commercially available under the name of Oxazolin wax TX2.

The amount of initially added oxazolin wax may vary, but should be sufficient to coat the discrete crystals. Hence, the oxazolin wax is added, in an introductory wet granulation stage, dissolved in a suitable solvent such as trichloroethane or chlorothene, to the crystalline explosives suspended in the mixing water, possibly together with similarly suspended solid particulate substances in the form of powdered aluminum or the like, whereafter the temperature of the mixing water is raised, under agitation, to or slightly above the boiling point of the solvent and is held there until such time as all solvent has been driven-off, whereupon the oxazolin wax is successively deposited on the solid particles. Thereafter, the phlegmatization agent proper in the form of, for example, Wax Composition 1 or type D2 is added. As a rule, a further temperature elevation is thereafter required for melting of the phlegmatization agent, whereafter the temperature of the mixing water, under suitable agitation, is progressively reduced to engender deposition of the phlegmatization agent on the oxazolin wax.

Such a pretreatment with oxazolin wax has proved to facilitate the phlegmatization process and to give a more uniform granulation, at the same time as the above-mentioned flocculation tendencies are suppressed. This relates both to pure granulated explosives and to composite products of the type hexotonal and octonal.

We have, also found that it is possible to produce an excellent starting material for PBX in the form of uniformly plastic-coated explosive granules if the explosive crysalt or particles are first coated with a thin layer of oxazolin wax and the oxazolin wax-coated particles are then coated and granulated with the plastic binder under consideration herein. The explanation for this is that the oxazolin wax has proved to possess an excellent basis for further coating of these with some of the plastic types which may come into consideration as binders in PBX. Hence, according to the present invention, oxazolin wax is first added dissolved in a suitable solvent such as trichlorethane or chlorothene (methyl chloroform) to the water-dispersed explosives particles and, thereafter, the solvent is successively driven-off under continuous agitation and temperature regulation of the suspension, such that the oxazolin wax is caused to deposit evenly over the explosive particles. Only when the explosive particles have been provided, in this manner, with a thin and substantially total superpositive layer of oxazolin wax is the plastic binder added, dissolved or dispersed in a specifically intended solvent or dispersion agent, whereafter this latter is removed or drive-off in, per se, known manner under agitation and temperature regulation of the dispersion, the plastic binder in its turn being caused to deposit on the previously obtained oxazolin wax layer. In this way, there will be obtained an excellent PBX consisting of granules of uniform size which are completely coated with plastic layers of even thickness.

It is of no material consequence whatsoever for the method according to the present invention whether the plastic solution or dispersion is added dropwise to an explosive dispersion which is at a higher temperature than the boiling point of the solvent or dispersion agent of the plastic such that this boils off more or less instantaneously, or whether the entire batch of plastic is added to the cold explosive dispersion and the temperature thereof is subsequently elevated for boiling-off the solvent or dispersion agent of the plastic.

The method according to the present invention has been defined in the appended claims, and will be described in greater detail below in conjunction with the following non-restrictive Examples:

EXAMPLE 1

"Method of producing plegmatized octogen"

A volume of 150 liters of water and 47.5 kg of octogen whose mean particle diameter was 170 μm, particle size ranging between 100 and 300 μm, and 0.04% of oxazolin wax TX2 dissolved in chlorothene (the amount of oxazolin wax being calculated on the amount of explosives) were added to a reaction vessel equipped with a mechanical agitator and provided with a heat exchanger disposed for heating and cooling. The water temperature was raised to 95° C. and, during this temperature elevation, the chloroethene was driven off and the oxazolin wax deposited on the crystalline explosive. One the chlorothene had been driven off and the contemplated temperature had been attained, 2.5 kg of phlegmatization wax (Wax Composition 1) was added and the batch was held at a constant temperature for 10 minutes. Thereafter, the batch was cooled and Nutsch-filtered. The result was a homogeneous product with the phlegmatization wax evenly and uniformly distributed over the crystal surfaces. The particle size distribution of the thus obtained product was even narrower than it would have been had a corresponding product been produced without oxazolin wax. As has been mentioned above, the employment of oxazolin wax gives a more uniform distribution of the phlegmatization agent over the different particles and thereby avoids the formation of such coarse particles as consist, for the major part, of wax alone.

The even and uniform phlegmatization is crucially important if the product is to be compressed to compact body, as is, for example, the topical case in the production of initiators or primary explosives and the like. In this case, the mean particle size of the thus obtained particles are approximately 350 μm.

EXAMPLES 2 AND 3

"Method of producing plegmatized hexogen and PETN.

Corresponding Examples were also carried out under corresponding conditions with hexogen and PETN, respectively, of essentially the same mean particle size and with corresponding results.

EXAMPLE 4

"Method of producing pBX

The following process has been employed for the production of the plastic bonded explosive (PBX) PBX-MIL Spec. Type A, containing 8.5% polystyrene (PS), 1.5% diocthylphthalate (DOP) and 90.0% hexogen.

90 g of hexogen (mean particle diameter approximately 100 μm) is slurried in 500 ml of water 1.5 ml of oxazolin solution (15 g/l clorothene) is added and the batch is heated to 90° C. A solution of PS, 8.5 g, and DOP, 1.5 g, in 50 g of methylethylketone is added and the solvent is distilled-off. The batch is cooled and the product is filtered-off and dried. The result is an excellently granulated PBX, which fully satisfies the military standard MIL-P 14999.

EXAMPLE 5

"Method of producing PBX

The following process, similar to that disclosed under Example 1, has been employed to produce PBXN-2, a PBX containing 5.3% Elvamid 8061 (a Nylon) and 94.7% octogen.

94.7 g of octogen (mean particle diameter 50–100 μm) is slurried in 500 ml of water and 1.5 ml of oxazolin solution is added. The batch is heated to 90° C., when 5.3 g of Elvamid dissolved in 50 ml of methanol is added, whereafter heating is continued to 95° C. so as to drive-off all solvent. After cooling, filtering and drying, there is obtained an excellent product with a mean particle diameter of approximately 0.5–1.0 mm.

EXAMPLE 6

"Method of producing PBX

The process as disclosed under Example 2 was repeated, substituting octogen with 66% hexogen (mean particle diameter approximately 100 μm) and powdered aluminium 25%, together with an increase of the Elvamid content to 9%. The final product will be granules of a mean particle diameter of approx. 0.5–1.0 mm, fully satisfying the requirements as laid down according to NAVORD Syst. Command OS11632A.

We claim:

1. A method for the phlegmatization of crystalline explosives wherein included with said crystalline explosives is at least one solid, particulate, non-explosive substance by wet granulation in water with a phlegmatization agent or binder agent or both which comprises providing a granulation suspension of the crystalline explosives and said at least one solid, particulate, non-explosive substance in water;

adding a solution of oxazolin wax in a solvent to said granulation suspension such that said oxazolin wax provides for a minor portion of the phlegmatization agent or binder agent; driving off the solvent for the oxazolin wax under continuous agitation of the granulation suspension in order that said oxazolin wax is deposited on the surfaces of the crystalline explosives and the particulate non-explosive substance; and then adding the phlegmatization agent or binder agent or both whereby the phlegmatization agent or binder agent or both under continued and continuous agitation and temperature regulation of the granulation suspension is deposited on the oxazolin wax, thereby providing a total superposition and granulation of the crystalline explosives and particulate non-explosive substance.

2. The method of claim 1 wherein said crystalline explosive substances include a member selected from the group of octogen, hexogen, PETN, and mixtures thereof.

3. The method of claim 2 wherein said non-explosive substance includes powdered aluminum.

4. The method of claim 2 wherein said solvent includes trichloroethane.

5. The method of claim 2 wherein said non-explosive substance includes powdered aluminum and said solvent includes trichloroethane.

6. The method of claim 1 wherein said non-explosive substance includes powdered aluminum.

7. The method of claim 1 wherein said solvent includes trichloroethane.

8. The method of claim 1 wherein said non-explosive substance includes powdered aluminum and said solvent includes trichloroethane.

9. The method of claim 1 wherein the oxazolin wax is added in an amount corresponding to from 0.01 to 0.1 weight percent calculated on the crystalline explosives and solid, particulate, non-explosive substance.

10. A method for providing a plastic-bonded explosive containing particulate explosive substances and a plastic binder between the particulate explosive substances which comprises providing a water dispersion of said plastic-bonded explosive;

adding a solution of oxazolin wax in a solvent to said water dispersion;

driving off the solvent for the oxazolin wax to thereby cause the oxazolin wax to deposit on the particulate explosive substances;

then coating the oxazolin wax coated particles with a plastic binder; and combining the coated particles together to form said plastic-bonded explosive.

11. The method of claim 16 wherein said particulate explosive substances include a member selected from the group of hexogen, octogen, PETN, and mixtures thereof.

12. The method of claim 10 wherein said plastic-bonded explosive further includes a non-explosive particulate substance.

13. The method of claim 12 wherein said non-explosive particulate substance includes aluminum.

14. The method of claim 12 wherein said solvent includes trichloroethane.

15. The method of claim 10 wherein said solvent includes trichloroethane.

16. The method of claim 10 which further includes granulating the oxazolin wax coated particles.

17. A phlegmatized crystalline explosive produced according to the method of claim 1 and containing crystalline explosives and solid, particulate, non-explosive substance coated with a thin inner layer of oxazolin wax and an outer superposition layer of phlegmatization agent or binder agent or both surrounding said thin inner layer.

18. A plastic-bonded explosive produced according to the method of claim 10 and containing particulate explosive substances coated with a thin layer of oxazolin wax and an outer superposition layer of a plastic binder surrounding said thin inner layer.

* * * * *